US006439959B1

(12) United States Patent
Magrone et al.

(10) Patent No.: US 6,439,959 B1
(45) Date of Patent: Aug. 27, 2002

(54) WIRELESS SUPPORT FOR BRASSIERE

(75) Inventors: Frank Magrone, Naples, FL (US); Valerie Audrey Totty, Cumming, GA (US); Judith L. Falcicchio, Bayonne, NJ (US)

(73) Assignee: Vanity Fair, Inc., Wilmington, DE (US)

( * ) Notice: Subject to any disclaimer, the term of this patent is extended or adjusted under 35 U.S.C. 154(b) by 0 days.

(21) Appl. No.: 09/908,837

(22) Filed: Jul. 20, 2001

Related U.S. Application Data

(60) Provisional application No. 60/219,408, filed on Jul. 20, 2000.

(51) Int. Cl.[7] ..... A41C 3/00
(52) U.S. Cl. ..... 450/41; 450/43
(58) Field of Search ..... 450/41–52; 2/255, 2/260, 260.1, 261

(56) References Cited

U.S. PATENT DOCUMENTS 2,992,646 A * 7/1961 Weinberg ..... 450/41
3,196,460 A * 7/1965 Halstead ..... 450/41
3,351,954 A * 11/1967 Chalfin et al. ..... 450/41
5,660,577 A * 8/1997 Modena ..... 450/86

FOREIGN PATENT DOCUMENTS

WO WO 99/48392 9/1999

* cited by examiner

*Primary Examiner*—Gloria M. Hale
(74) *Attorney, Agent, or Firm*—Pennie & Edmonds LLP

(57) ABSTRACT

This invention is directed to a wireless support system for a brassiere. The wireless support system comprises a three-dimensional frame having a sling section and a lower frame section. The sling section and lower frame section may be separate pieces that are sewn together in the three-dimensional shape, or they may be one piece that is molded into the desired three-dimensional shape. The lower frame is provided between the underarm areas and fits underneath the breasts. The sling portion comprises two cup portions and two extending arms that reach into the straps of the brassiere to provide lift and support to the breasts. The frame is preferably sewn into the interior of a brassiere between an outer material of the brassiere and an inner material of the brassiere that resides against the wearer's skin.

23 Claims, 8 Drawing Sheets

WIRELESS SUPPORT FOR BRASSIERE

CROSS-REFERENCE TO RELATED APPLICATIONS

The benefit of Provisional Application No. 60/219,408 filed Jul. 20, 2000 is claimed under 35 U.S.C. §119(e).

FIELD OF THE INVENTION

This invention is directed to brassieres. More particularly, this invention is directed to a wireless support system for a brassiere or other breast supporting garments.

BACKGROUND OF THE INVENTION

Brassieres provide support and enhance the shape of breasts. Brassieres often have a device in the cups of the brassiere to provide support. Devices intended to provide support and shaping for the cups of a bra and similar articles have long been known. These devices are commonly known as underwires and are inserted into and held within a fabric sleeve disposed about the periphery of the lower section of the bra cup. They are made from materials, such as bone, metal or plastic, and are provided in various forms, shapes and cross-sections. Most commonly, the underwire is formed of relatively thin metallic pieces of rectangular cross-section, shaped into an essentially semi-circular or U-shaped form that allows the underwire to be fitted within a sleeve disposed about the periphery of the lower half of the bra cup.

While such underwire structures have achieved widespread usage, a number of significant disadvantages result from their use. In particular, the underwires can damage the fabric sleeve into which the underwire is inserted or irritate the skin of a user leading to discomfort and sometimes bruising. Deformation or distortion of the underwires arises from washing and drying of bras containing underwires. Multiple washings lead to degradation of the fabric of the garment due to shrinkage of the fabric and/or the relative movement occurring between the stiff, rigid metal underwire and the fabric of the bra brought about in machine washing and drying. Using underwires coated with a polymeric material or metal underwires that have plastic tips at their ends does not alleviate these problems completely.

Moreover, underwires require different designs for different style and/or size bras. Further, each underwire has to be sewn into a fabric sleeve of the bra during assembly. This requires additional labor and increases costs of manufacture and materials.

SUMMARY OF THE INVENTION

The invention is related to a brassiere including a front bodice having an inner layer and an outer layer that may be formed of fabric, a back bodice secured to the front bodice, and a wireless frame. The wireless frame include a lower frame portion having an upper edge and a lower edge, two cup portions disposed proximate the upper edge, and at least one extending arm extending from each cup portion. The brassiere also includes at least one shoulder strap for coupling the back bodice at least one of the front bodice and frame. In addition, the frame is disposed between the inner and outer layers.

In some embodiments, the at least one shoulder trap may couple the back bodice to a cup portion, and in others the at least one shoulder strap may be secured to the at least one extending arm. The at least one shoulder strap may surround at least a portion of the at least one extending arm.

The front bodice may surround the frame of the brassiere. In order to retain the frame, the front bodice may have a lower seam, a first side seam and a second side seam, and an at least one shoulder strap connection portion. The frame may have a periphery and may be retained proximate the periphery.

In some embodiments, the frame is formed of unitary construction, while in others the frame is formed of at least two portions that are coupled together. Polyurethane may be used to form the frame.

The frame may further include a sling portion proximate the upper edge of the lower frame portion, with the sling portion connecting the cup portions. The back bodice may include two back straps, each strap having a first end and a second end, with the first ends being secured to the front bodice and the second ends b mg secured to each other. Such an arrangement of second ends may be releasably securable.

The invention also relates to a brassiere that includes a unitary molded support body. The support body has a lower support portion with a top edge and a bottom edge, two cup portions disposed proximate the top edge, and at lest one extending arm extending from each cup portion. The support body is disposed within a front portion of the brassiere and the brassiere is free of wires.

The invention further relates to a support for a brassiere including a lower frame portion having an upper edge and a lower edge and at least one sling portion disposed proximate the upper edge of the lower frame portion. Two cup portions are provided on the at least one sling portion proximate the upper edge of the lower frame, each cup portion having an inner part and an outer part. In addition, the support includes two extending arms each having an upper end and each extending from the outer part of a cup portion. The support is wireless and at least the lower edge of the lower frame and the upper end of the extending arms are configured for coupling to surrounding structure of the brassiere.

The support may be a molded, unitary construction. The lower frame portion may include a first section, and the at least one sling portion may include second and third sections coupled together and attached to the lower frame portion. The lower frame and the sling portions may be sewn together, and the support may be formed of polyurethane. The support may be substantially formed of a single polymeric material.

This invention additionally is directed to a wireless support system for a brassiere. The wireless support system comprises a three-dimensional frame having a sling section and a lower frame section. The sling section and lower frame section maybe separate pieces that are sewn together into the three-dimension shape, or they may be one-piece that is molded into the desired three-dimensional shape. he lower frame is provided between the underarm areas and fits underneath the breasts. The sling portion comprises two cup portions and two extending arms that reach into the straps of the brassiere to provide lift and support to the breasts. The sling portions support the heaviest part of the breasts, as they are located under the bust and at the sides to contain the breasts and provide support and lift. The slings have a three-dimensional circumferential shape surrounding the breasts. The extending arms reach into the shoulder straps of th[0085] brassiere to provide additional lift and support through the shoulder straps. Preferably , the frame is made of a soft flexible foam such as polyurethane. The frame, once made, is preferably sewn into the interior of a brassiere between an outer material of the brassiere and an inner material of the brassiere that resides against the wearer's skin.

DETAILED DESCRIPTION OF THE PREFERRED EMBODIMENTS

Figure 1:
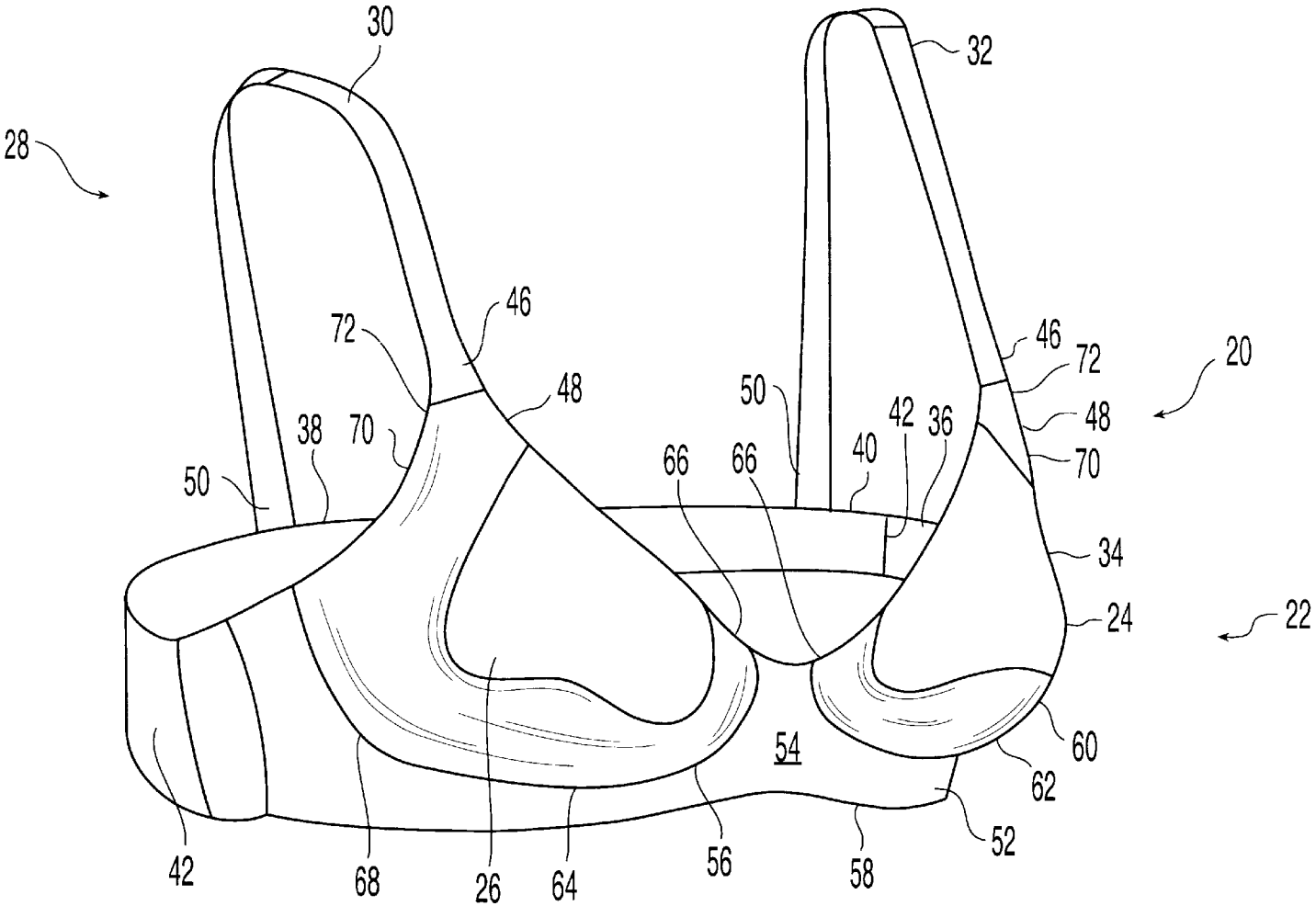
FIG. 1 is a perspective view of a brassiere showing a frame of a wireless support system according to the present invention.

Referring to FIG. 1, a perspective view of a bra 20 made according to the present invention is shown. It will be understood that the present invention can be incorporated into any style bra or undergarment known to those of ordinary skill in the art. The bra 20 features a front bodice 22 having two breast receiving cups 24 and 26, a back bodice 28, preferably having a releasable fastener (not shown), d shoulder straps 30 and 32. The front bodice 22 is formed of an outer layer 34 and an inner layer 36 of fabric. The outer layer is typically made of decorative material such as lace or satin. The inner layer is preferably made of a soft material that absorbs and wicks moisture away such as woven cotton or polypropylene cloth. The back bodice 28 is preferably made of two back straps 38 and 40 each having two ends, with one end 42 attached to the front bodice at an underarm area and extending backward. A releaseable fastener (not show is used to attached the two second ends (not shown) of the straps together in the typical fashion known to those of ordinary skill in the art. The shoulder straps 30 and 32 are each located with a first end 46 adjacent the top edge 48 of a breast cup 24, 26 and a second end 50 attached to the corresponding back strap 38, 40.

According to the present invention, a three-dimensional frame 52 is located between the inner and outer layer of the front bodice. The frame 52 features a lower frame 54 having an upper edge 56 and a lower edge 58 and rests against the rib cage of the wearer. A sling portion 60 is located along the upper edge 56 of the lower frame 54. The sling portion 60 has two cup portions 62 and 64 each shaped to cover a portion of the breasts of the wearer. The cup portions each have an inner and outer section 66 and 68. The inner sections 66 are adjacent each other between the cups 24 and 26 of the bra 20. An extending arm 70 extends from the outer section 68 of each cup portion 62 and 64 and an upper end 72 of each extending arm extends into the corresponding shoulder strap 30 and 32 of the bra 20. At least the lower edge 58 of the lower frame 54 and the upper ends 72 of the extending arms 70 are attached to the bra 20.

Figure 3:
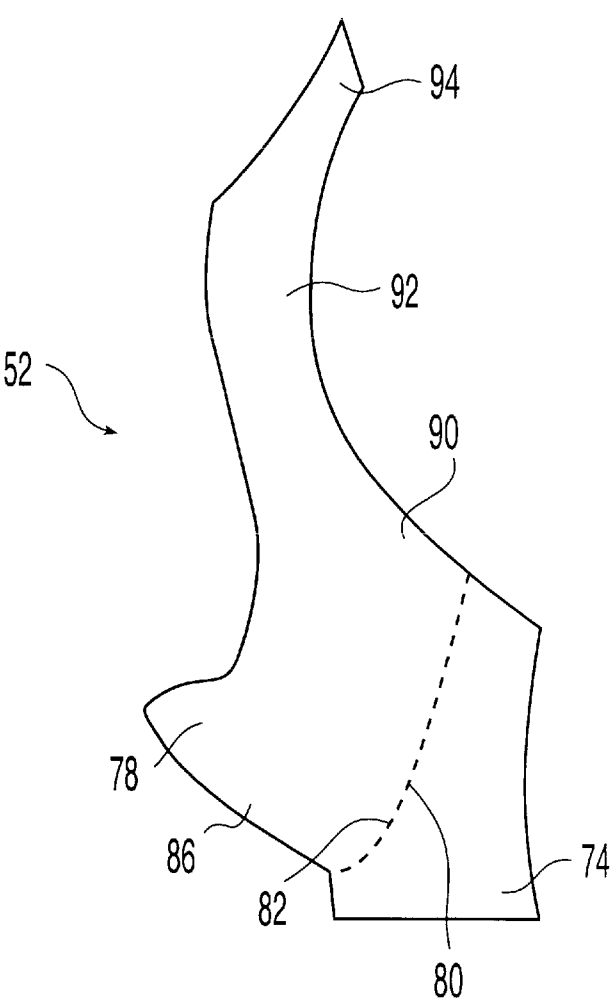
FIG. 3 is a side view of the frame of the wireless support system of FIG. 2.
Figure 2:
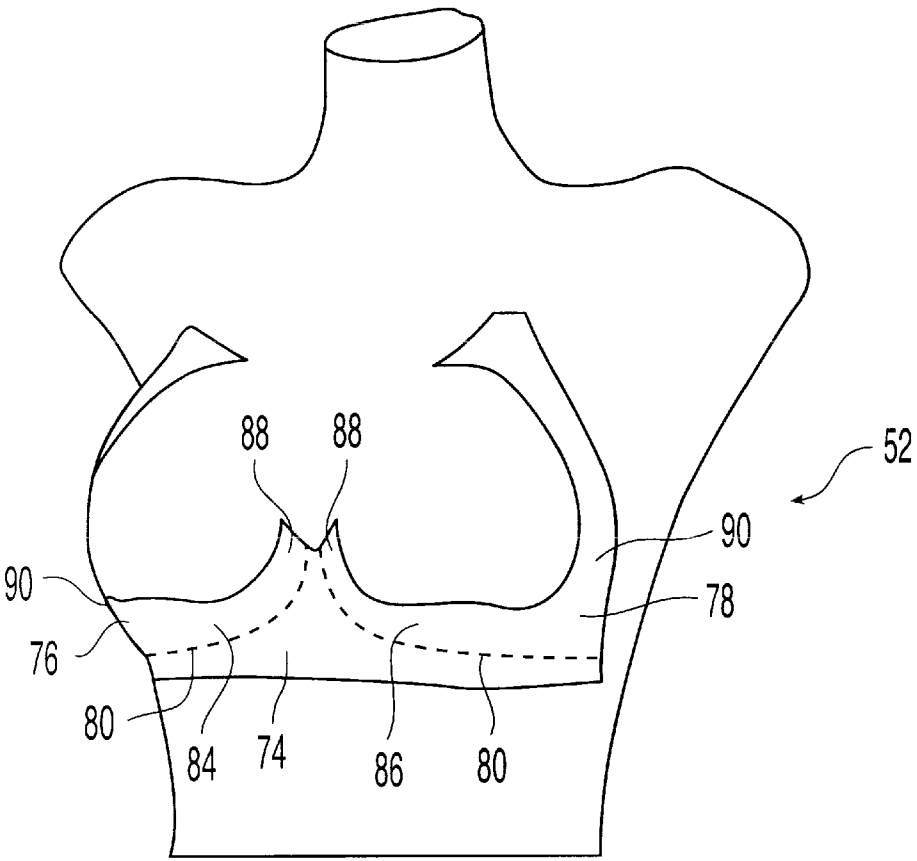
FIG. 2 is a perspective view of a first embodiment of a frame of a wireless support system according to the present invention.

The frame 52 may be made of a single piece or it may be made of two, three or more separate pieces. For example, as shown in FIGS. 2–6, the frame 52 is made of three pieces, a lower frame 74, a first sling portion 76 and a second sling portion 78. The pieces are joined together by sewing along the seams 80 to form the three-dimensional shape of the breast cups 24 and 26 as shown in FIG. 3. As shown in FIG. 2, he lower frame 74 extends between each underarm area and rests against the rib cage of the wearer. The sling portions 76 and 78 are attached to an upper edge 82 of the lower frame 74 and feature cup portions 84 and 86 to support the breasts. The cup portions 84 and 86 have an inner section 88 adjacent each other between the breasts, and an outer section 90 adjacent the underarm area. An extending arm 92 extends from each outer section 90 and arcs in a circumferential manner around the outside of the breast. An upper end 94 of each extending arm 92, is preferably attached to the corresponding shoulder strap 30 and 32 to provide additional support to the breasts from the shoulder straps. Thus, the sling portions support the heaviest part of the breasts, as they are located under the breasts and at the sides to contain the breasts to provide support and lift. Further, the extending arm 92 provides additional support and lift from each shoulder strap. As shown in FIGS. 2 and 3 seams 80 under the cup portions attach the lower frame to the sling portions to form the three-dimensional shape of the frame. Preferably, the pieces are sewn together with a two step zig-zag stitch.

Figure 4:
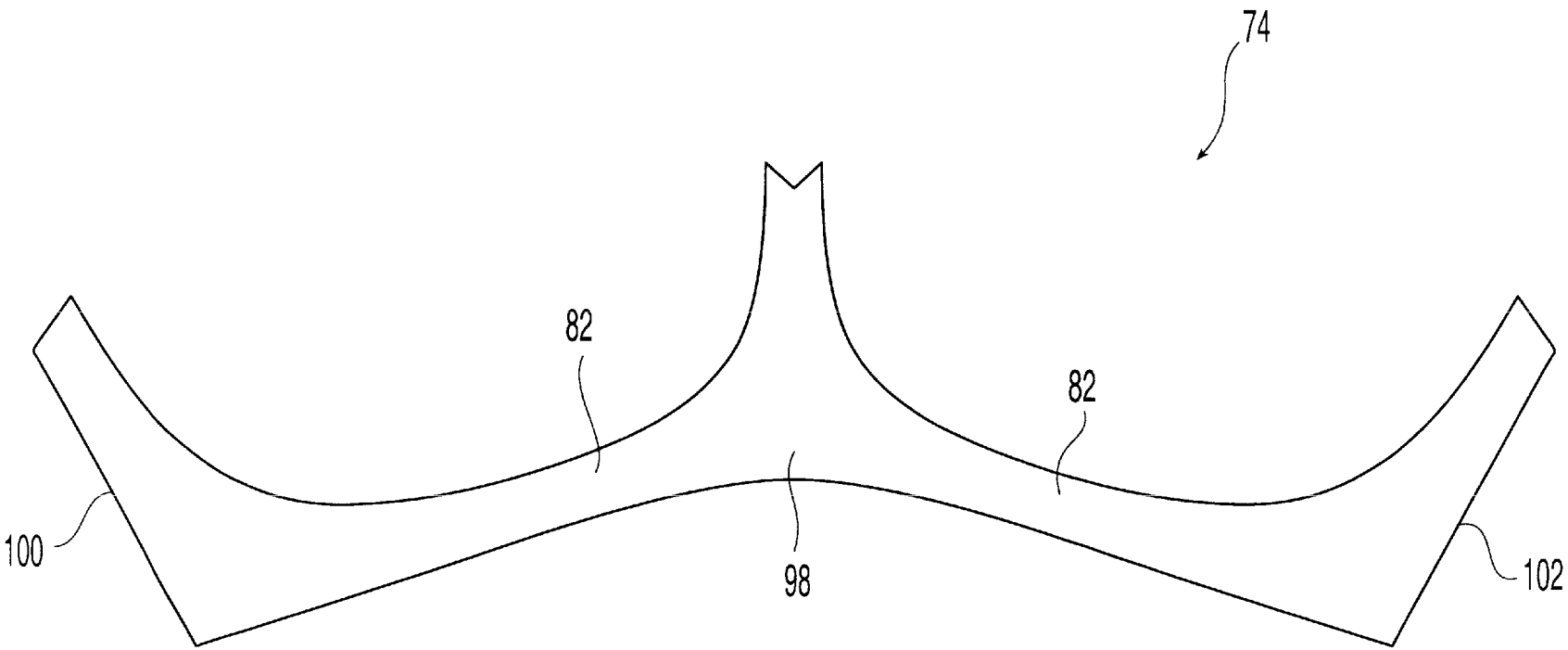
FIG. 4 is a front view of a lower frame of the wireless support system of FIG. 2 before assembly.
Figure 5:
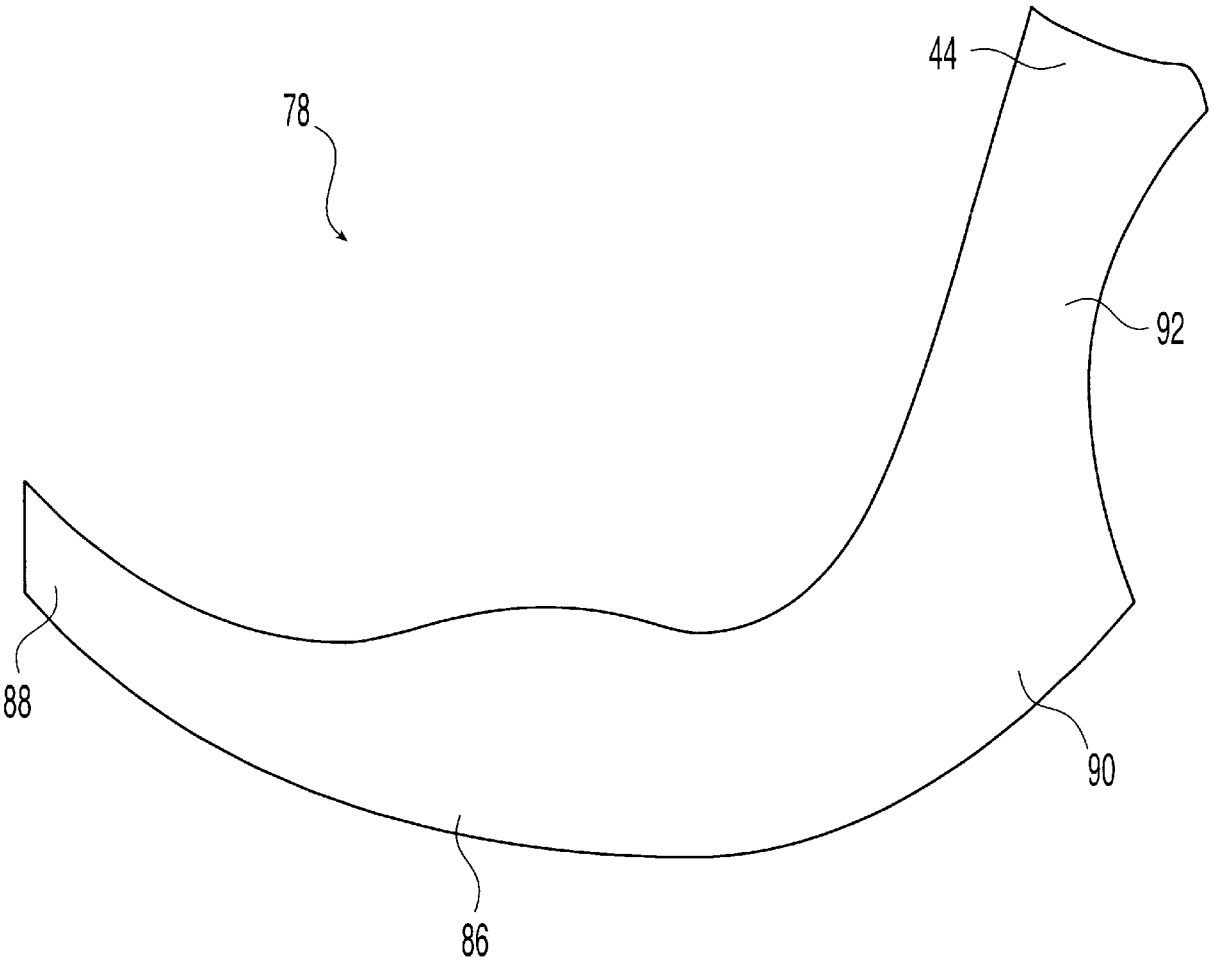
FIG. 5 is a front view of a first sling portion of the frame of the wireless support system of FIG. 2 before assembly.
Figure 6:
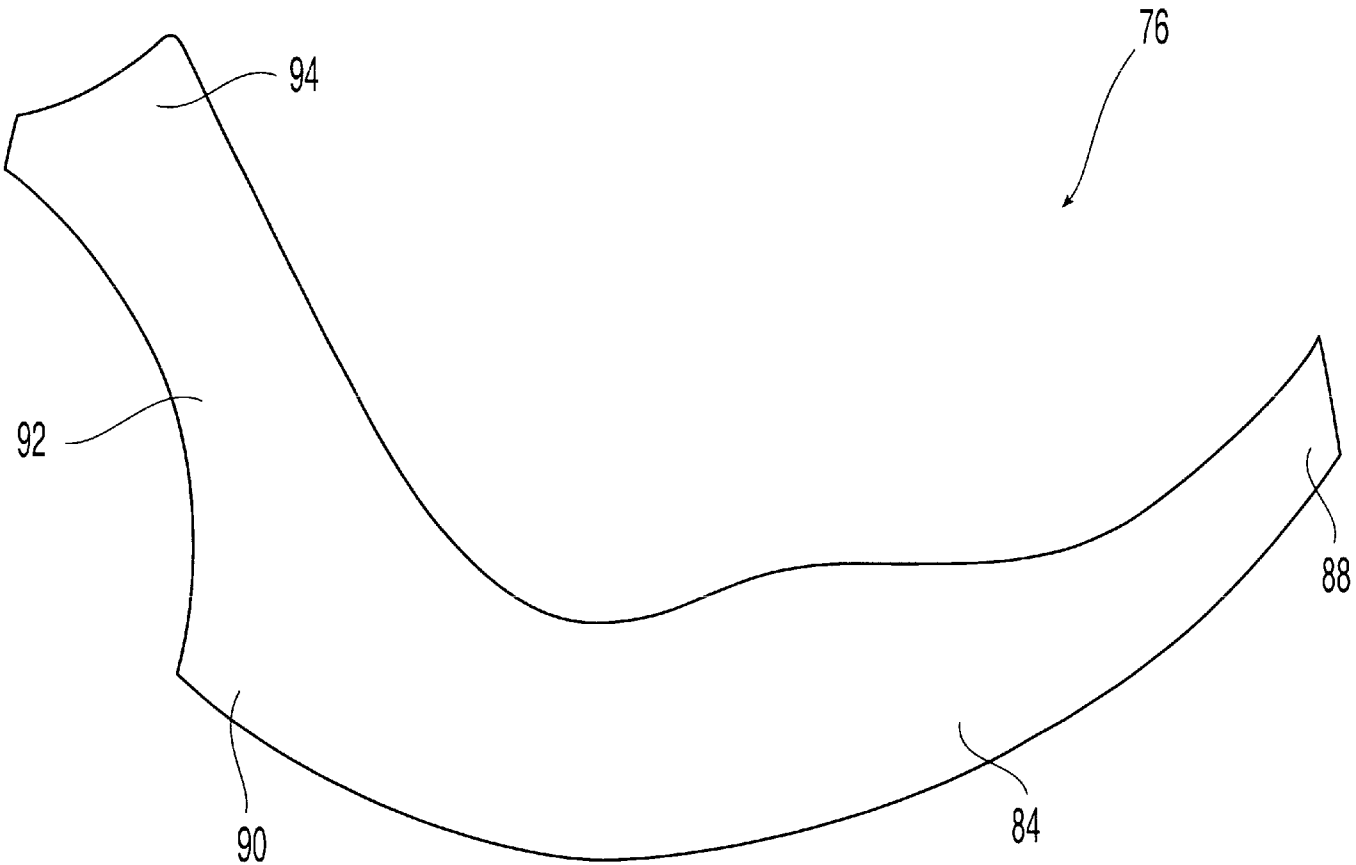
FIG. 6 is a front view of a second sling portion of t frame of the wireless support system of FIG. 2 before assembly.

FIG. 4 shows an outline of the lower frame 74 having upper and lower edges 82 and 98, respectively, and first and second underarm portions 100 and 102, respectively. FIGS. 5 and 6 show the outline of the first and second sling portions 76 and 78 including the cup portions 84 and 86, the inner and outer sections 88 and 90, and the extending arms 92, each having an upper end 94. The first and second sling portion 3 may also be formed as a single piece.

Figure 8:
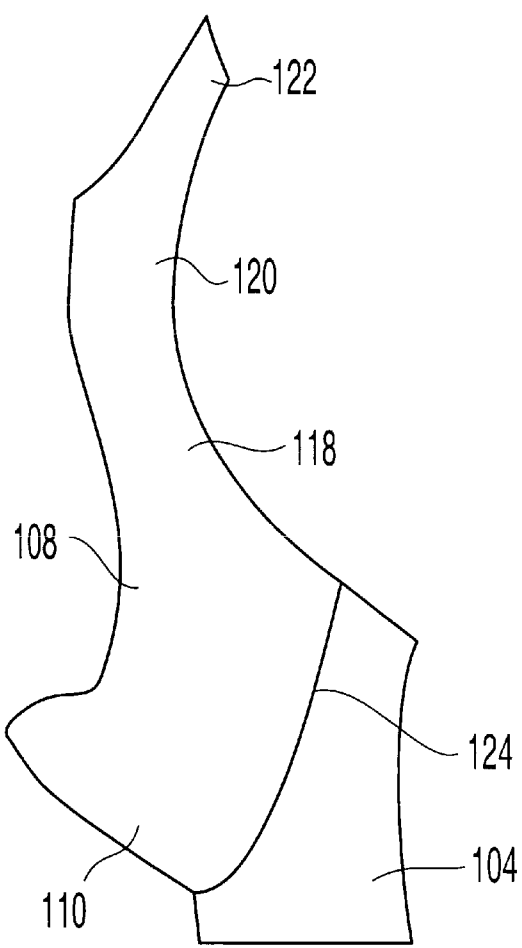
FIG. 8 is a side view of the frame of the wireless support system of FIG. 7.
Figure 7:
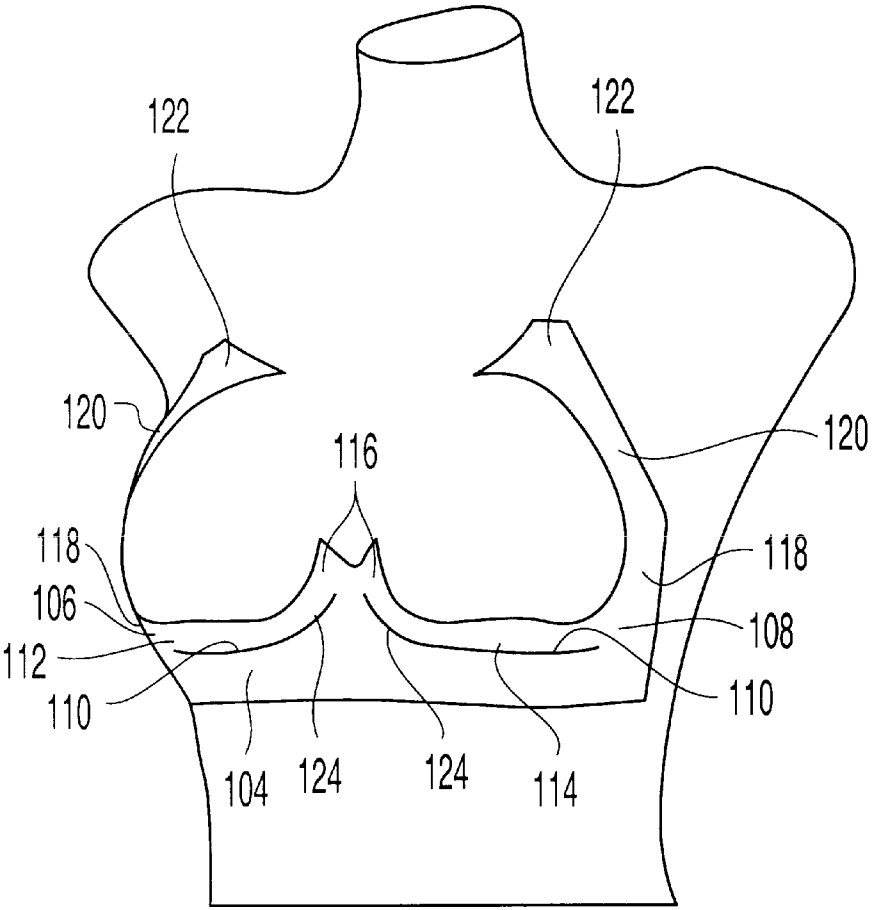
FIG. 7 is a perspective view of a second embodiment of the frame of the wireless support system according to the present invention.
Figure 9:
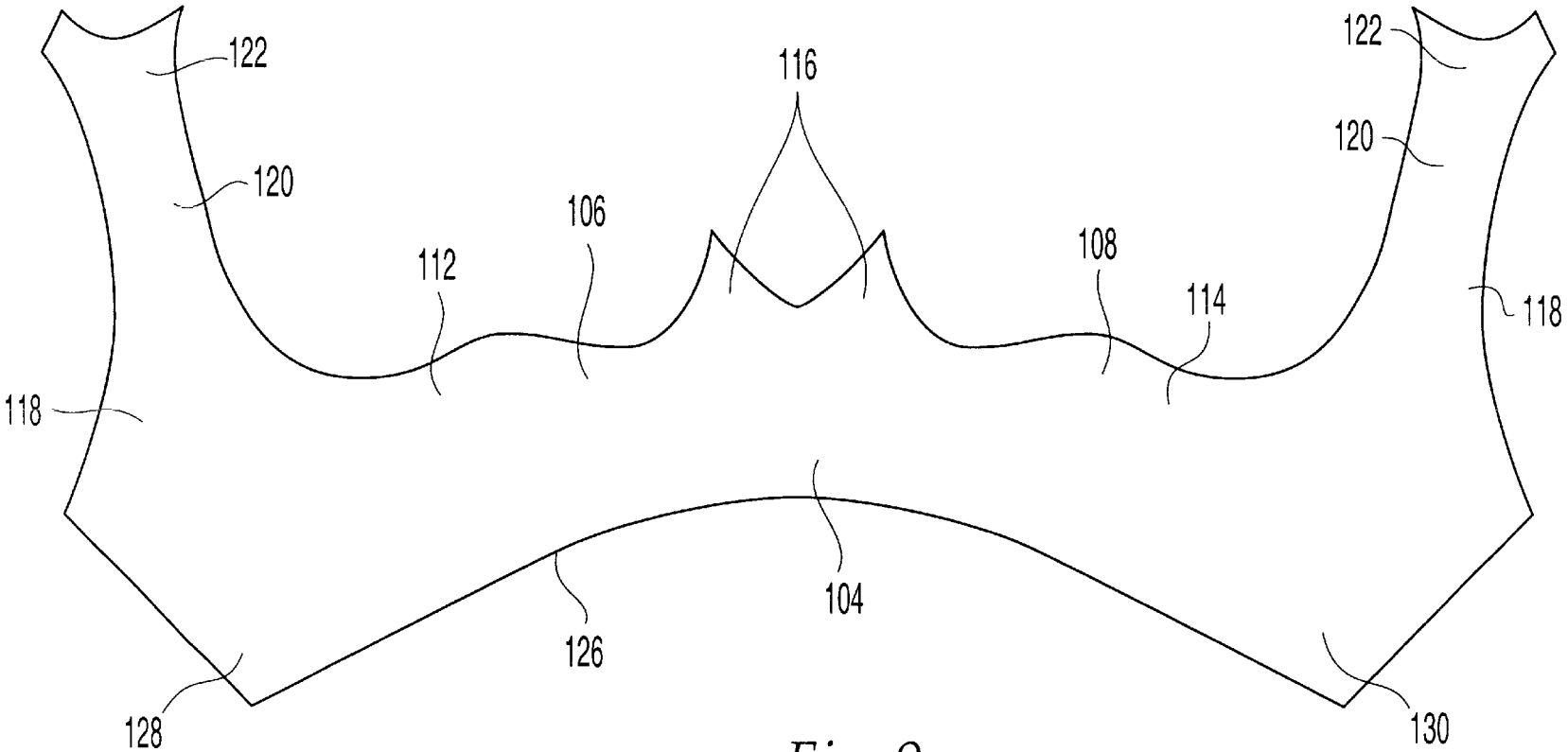
FIG. 9 is a front view of the frame of the wireless support system of FIG. 7 before molding.

Referring to FIGS. 7–9, the frame 52 is made of one piece, including a lower frame 104, a first sling portion 106 and a second sling portion 108 are all made of one piece of material. The frame is formed into the three-dimensional shape of the breast cups as shown in FIG. 8 by molding the frame into the desired three-dimensional shape. As shown in FIG. 7, the lower frame 104 extends between each underarm area and rests against the rib cage of the wearer. The sling portions 106 and 108 curve from upper edge 110 of the lower frame 104 and feature cup portions 112 and 114 to support the breasts. The cup portions 112 and 114 have an inner section 116 adjacent each other between the breasts, and an outer section 118 adjacent the underarm area. An extending arm 120 extends from each outer section 118 and arcs around the outside of the breast in a circumferential manner. An upper end 122 of each extending arm 120, is preferably attached of the shoulder strap 30 and 32 to provide additional support to the breasts from the shoulder straps. Thus, the sling portions 106 and 108 support the heaviest part of the breasts a they are located under the breasts and at the sides to contain the breasts to provide support and lift. Further, the extending arm 120 provides additional support and lift from each shoulder strap. As shown in FIGS. 7 and 8, mold lines 124 under the breasts form the three-dimensional shape of the frame.

FIG. 9 shows an outline of the frame before molding having an lower frame 104 with a lower edge 126, and first and second underarm portions 128 and 130, respectively. The first and second sling portions 106 and 108 include the cup portions 112 and 114, the inner and outer sections 116 and 118 of the cup portions, and the extending arms 120, each having an upper end 122. Preferably, the piece is molded by a male/female hot molding machine. Preferably, for whites, the dwell is for 75 seconds at a temperature of 415° F. for the top or male mold and 410° F. for the bottom or female mold to achieve the desired three-dimensional shape. Preferably, for colors, the dwell is for 80 seconds at a temperature of 405° F. for the top or male mold and 400° F. forth bottom or female mold to achieve the desired three-dimensional shape. The lining and the outside material are preferably molded simultaneously, in blocks, and subsequently cut out along the impression lines. The bra is then assembled.

The frame 52 of the present invention is preferably made of polyurethane material or a fiber fill material, and most preferably of a soft polyurethane material.

Figure 10:
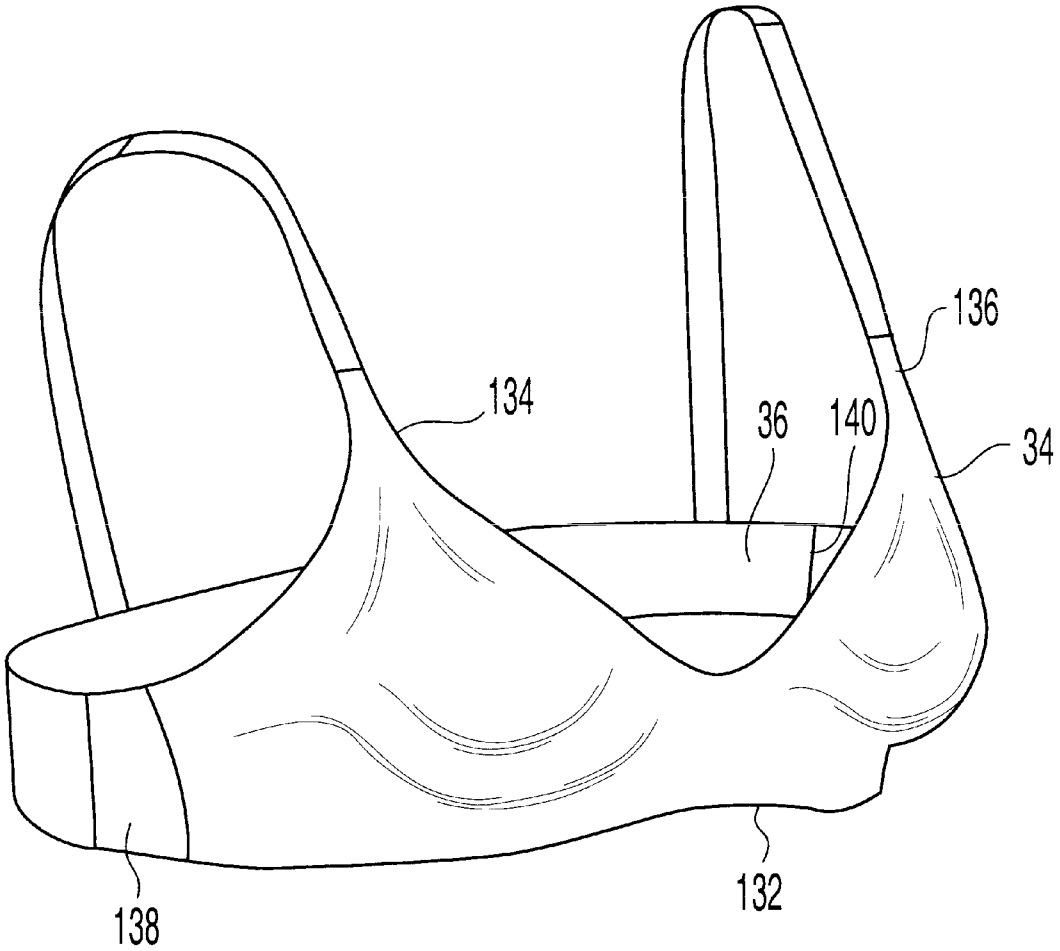
FIG. 10 is a perspective view of a brassiere incorporating the wireless support system according to the present invention.

Now referring to FIG. 10, the finished bra is shown. The frame is sandwiched between inner and outer layers 36 and 34 of material may have the appearance of a regular bra. Preferably, the frame 52 is at least attached to the bra at a lower seam 132 and at the ends of the shoulder straps 134 and 136. More preferably, the frame 52 is additionally attached to the bra at two side seams 138 and 140.

While it is apparent that the illustrative embodiments of the invention herein disclosed fulfills the objectives stated above, it will be appreciate that numerous modifications and other embodiments may be devised by those killed in the art. For example, the present invention could be made of a variety of materials and could be molded at different temperatures for different periods of time. Further, the sling portion of the frame could be shaped differently to provide different support for different bust sizes. Therefore, it will be understood that the appended claims are intended to cover all such modifications and embodiments which come within the spirit and cope of the present invention.

We claim:

1. A brassiere comprising:

a front bodice having an inner layer and an outer layer;

a back bodice secured to the front bodice;

a molded, wireless frame comprising a lower frame portion having an upper edge and a lower edge, two cup portions disposed proximate the upper edge, and at least one extending arm extending from each cup portion; and at least one shoulder strap coupling the back bodice to at least one of the front bodice and frame, wherein the frame is disposed between the inner and outer layers.

2. The brassiere of claim 1, wherein the a least one shoulder strap couples the back bodice to a cup portion.

3. The brassiere of claim 2, wherein the at least one shoulder strap is secured to the at least one extending arm.

4. The brassiere of claim 2, wherein the at least one shoulder strap surrounds at least a portion of the at least one extending arm.

5. The brassiere of claim 1, wherein the front bodice surrounds the frame.

6. A brassiere comprising:

a front bodice having an inner layer and an outer layer;

a back bodice secured to the front bodice;

a wireless frame comprising a lower frame portion having an upper edge and a lower edge, two cup portions disposed proximate the upper edge, and at least one extending arm extending from each cup portion; and at least one shoulder strap coupling the back bodice to at least one of the front bodice and frame, wherein the frame is disposed between the inner and outer layers, the front bodice surrounds the frame, and the front bodice further comprises a lower seam, a first side seam and a second side seam, and an at least one shoulder strap connection portion, wherein the frame is retained by the seams and the at least one shoulder strap connection portion.

7. The brassiere of claim 6, wherein the frame has a periphery and is retained proximate the periphery.

8. A brassiere comprising:

a front bodice having an inner layer and an outer layer;

a back bodice secured to the front bodice;

a wireless frame comprising a lower frame portion having an upper edge and a lower edge, two cup portions disposed proximate the upper edge, and at least one extending arm extending from each cup portion; and at least one shoulder strap coupling the back bodice to at least one of the front bodice and frame, wherein the frame is disposed between the inner and outer layers and the frame is formed of unitary construction.

9. The brassiere of claim 1, wherein the frame is formed of at least two portions that are coupled together.

10. A brassiere comprising:

a front bodice having an inner layer and an outer layer;

a back bodice secured to the front bodice;

a wireless frame comprising a lower frame portion having an upper edge and a lower edge, two cup portions disposed proximate the upper edge, and at least one extending arm extending from each cup portion; and at least one shoulder strap coupling the back bodice to at least one of the front bodice and frame, wherein the frame is disposed between the inner and outer layers and the frame is formed of polyurethane.

11. The brassiere of claim 1, wherein the inner and outer layers are formed of fabric.

12. A brassiere comprising:

a front bodice having an inner layer and an outer layer;

a back bodice secured to the front bodice;

a wireless frame comprising a lower frame portion having an upper edge and a lower edge, two cup portions disposed proximate the upper edge, and at least one extending arm extending from each cup portion; and at least one shoulder strap coupling the back bodice to at least one of the front bodice and frame, wherein the frame is disposed between the inner and outer layers, the inner and outer layers are formed of fabric, and the frame further comprises a sling portion proximate the upper edge of the lower frame portion, the sling portion connecting the cup portions.

13. The brassiere of claim 1, wherein the back bodice comprises two back straps, each strap having a first end and a second end, the first ends being secured to the front bodice and the second ends being secured to each other.

14. The brassiere of claim 13, wherein the second ends are releasably secured to each other.

15. A brassiere that includes a unitary molded support body comprising a lower support portion having a top edge and a bottom edge, two cup portions disposed proximate the top edge, and at least one extending arm extending from each cup portion, wherein the support body is surrounded within a front portion of the brassiere and the brassiere is free of wires.

16. A support for a brassiere having at least one shoulder strap, comprising:

a lower frame portion having an upper edge and a lower edge;

at least one sling portion disposed proximate the upper edge of the lower frame portion;

two cup portions provided on the at least one sling portion proximate the upper edge of the lower frame, each cup portion having an inner part and an outer part; and two extending arms each having an upper end and each extending from the outer part of a cup portion, wherein the support is wireless, at least the lower edge of the lower frame is configured for coupling to surrounding structure of the brassiere, and the upper ends of the extending arms are configured for coupling to the at least one shoulder strap.

17. The support of claim 16, wherein the support is a molded, unitary construction.

18. A support for a brassiere, comprising:

a lower frame portion having an upper edge and a lower edge;

at least one sling portion disposed proximate the upper edge of the lower frame portion;

two cup portions provided on the at least one sling portion proximate the upper edge of the lower frame, each cup portion having an inner part and an outer part; and two extending arms each having an upper end and each extending from the outer part of a cup portion;

the lower frame portion comprises a first section; and the at least one sling portion comprises second and third sections coupled together and attached to the lower frame portion;

wherein the support is wireless and at least the lower edge of the lower frame and the upper end of the extending arms are configured for coupling to surrounding structure of the brassiere.

19. A support for a brassiere, comprising:

a lower frame portion having an upper edge and a lower edge;

at least one sling portion disposed proximate the upper edge of the lower frame portion;

two cup portions provided on the at least one sling portion proximate the upper edge of the lower frame, each cup portion having an inner part and an outer part; and two extending arms each having an upper end and each extending from the outer part of a cup portion, wherein the support is wireless and at least the lower edge of the lower frame and the upper end of the extending arms are configured for coupling to surrounding structure of the brassiere, wherein the lower frame and the sling portions are sewn together.

20. The support of claim 16, wherein the support is formed of polyurethane.

21. The support of claim 16, wherein the support is substantially formed of a single polymeric material.

22. A method of manufacturing a brassiere comprising:

molding a wireless frame comprising a lower frame portion having an upper edge and a lower edge, two cup portions disposed proximate the upper edge, and at least one extending arm extending from each cup portion;

disposing the frame between inner and outer layers of a front bodice;

securing a back bodice to the front bodice;

coupling the back bodice to at least one of the front bodice and frame with at least one shoulder strap.

23. The method of claim 22, wherein the frame is molded to have a unitary construction.

* * * * *